United States Patent [19]

Kim et al.

[11] 4,217,139

[45] Aug. 12, 1980

[54] PROCESS OF PREPARING AN ELECTRICAL CONTACT MATERIAL

[75] Inventors: Han J. Kim, Greensburg, Pa.; Thomas E. Peters, Chelmsford, Mass.; David Snee, Murraysville, Pa.

[73] Assignee: GTE Products Corporation, Stamford, Conn.

[21] Appl. No.: 970,507

[22] Filed: Dec. 18, 1978

Related U.S. Application Data

[63] Continuation of Ser. No. 832,097, Sep. 9, 1977, abandoned.

[51] Int. Cl.[2] ..... B22F 3/00

[52] U.S. Cl. ..... 75/206; 148/126; 75/200

[58] Field of Search ..... 75/206, 200; 148/126

[56] References Cited

U.S. PATENT DOCUMENTS

| | | | |
|---|---|---|---|
| 3,135,601 | 6/1964 | Peiffer | 75/173 |
| 3,893,820 | 7/1975 | Davies et al. | 75/206 |
| 4,011,053 | 3/1977 | Davies | 75/206 |

*Primary Examiner*—Brooks H. Hunt

*Attorney, Agent, or Firm*—Robert E. Walter

[57] ABSTRACT

The instant invention relates to a method of preparing an electrical contact from sub-micron size silver and less than two micron size cadmium oxide particles with the contact having finally dispersed particles of cadmium oxide within grains of silver. In the instant invention the particles of silver and cadmium oxide are intimately blended together and subjected to a reducing atmosphere at a temperature of from 321° C. to 550° C. to reduce the cadmium oxide and form an alloy powder of cadmium and silver. The alloy formed is held at an elevated temperature following reducing and then oxidized at a temperature of from 321° C. to 550° C. to precipitate a dispersion of cadmium oxide within grains of silver and form a silver-cadmium oxide alloy powder. In an alternative embodiment an alloy powder of cadmium and silver already prepared from sub-micron size particles of silver and less than two micron size particles of cadmium oxide is heated to a temperature of from 321° C. to 550° C. in an inert atmosphere. The inert atmosphere is then changed to an oxidizing atmosphere at that temperature to precipitate the dispersion of cadmium oxide within the grains of silver. The material as prepared by both embodiments is then formed into an electrical contact.

7 Claims, 2 Drawing Figures

PROCESS OF PREPARING AN ELECTRICAL CONTACT MATERIAL

This is a continuation of application Ser. No. 832,097, filed Sept. 9, 1977, now abandoned.

BACKGROUND OF THE INVENTION

It is well known that sintered silver-cadmium oxide contact members are useful for electrical contact applications. Difficulty has been encountered, however, in both obtaining the desired high densification during sintering, due to the morphology associated with this material, as well as strength and erosion resistance at the operating temperatures of the contacts. In general, such silver-cadmium oxide contact members are prepared by pressing a mixture of silver-cadmium oxide powders into a compact and then sintering the compact by heating to a temperature of about 900° C. for about an hour. Following sintering, in order to further densify the compact, the compact is worked, such as by rolling or pressing.

Particular methods of preparing such contacts include a method such as disclosed in U.S. Pat. No. 3,317,991 wherein single phase silver-cadmium alloy shots, ranging in size from 100 microns to one mm, are formed by atomizing a silver-cadmium alloy. These shots are then subjected to an oxidization treatment to nucleate cadmium oxide particles both within and on the surface of the shots. The oxidized, 2-phase alloy shots are then compacted, sintered and extruded into a desired shape of acceptable density. Due to the use of shots, the oxidation is normally carried out at a high temperature, for example 800° C. for a long period of time. Times ranging from several hours to a day are necessary in order to achieve the desired oxidation due to the bulk of the shots and the slow diffusion of oxygen.

There is another similar process, disclosed in French Pat. No. 1,444,901 wherein a mixture of silver and cadmium oxide, silver oxide and cadmium oxide or silver oxide and cadmium powders is reduced to a homogeneous silver-cadmium alloy powder by heating to 500° C. in hydrogen for two hours. The reduced alloy powder is then oxidized in air or oxygen at a temperature between 400° C. and 650° C. After compacting and sintering, the sintered body is extruded into the desired shape.

There is still another similar proces for preparing silver-cadmium oxide alloy powders as disclosed in U.S. Pat. No. 4,011,052. In this method silver powder of up to 95 micron in diameter and cadmium oxide of up to 2 micron in diameter are blended and subjected to a reduction treatment by heating the mixture in a reducing atmosphere at a temperature between 321° C. and 700° C. The silver-cadmium alloy powder is then sieved and oxidized in air or oxygen by reheating from room temperature to a temperature between 400° C. and 600° C. to oxidize the alloy. The oxidized powder is again sieved, compacted and sintered. The sintered body is then reprocessed to obtain a high density level for the electrical contact application. At a selected time during the process before sintering an oxide of a metal from groups 1A and 2A of the periodic table is added.

The known methods described above, however, do not lead to alloy powders which can be compacted and sintered to an acceptable as-sintered density. Additional costly post-sintering operations such as high pressure coining or hot extrusion have to be performed in order to obtain electrical contact quality materials. The use of a more compactible and sinterable sub-micron size silver powder in any of the methods is either impossible due to impracticality of atomizing into that size range of powder, or coarsening of particles during oxidation to a level of poor sinterability. When a low oxidation temperature below about 550° C. is adopted in combination with the use of sub-micron size silver powder, the resultant powder renders blistered contacts with low as-sintered densities which are susceptible to fracture during subsequent working. Furthermore, the contacts of the materials produced by the known methods do not have optimum erosion resistance during operation. Therefore, the known methods are not designed to work with sub-micron size silver powder, to which the present invention is directed.

The present invention comprises a method of producing an electrical contact using sub-micron size silver powder and cadmium oxide powder, in combination with a low temperature process which avoids undue particle coarsening, to attain blister-free; acceptably high as sintered density compacts having high erosion resistance and ductility.

OBJECTS OF THE INVENTION

It is therefore a primary object of this invention to provide a method of producing a powder highly suitable for the preparation of electrical contacts and of high sinterability.

It is a further object of the present invention to provide a method as aforementioned capable of employing and retaining sub-micron size silver particles following oxidation of the powder blend and of producing blister-free electrical contacts.

It is yet a further object of the present invention to provide a method as aforesaid which produces an as-sintered electrical contact material having a uniform dispersion of cadmium oxide within grains of silver having improved ductility and a contact of high erosion resistance.

These and other advantages of the present invention will become more readily apparent hereinafter.

SUMMARY OF THE INVENTION

The present invention relates to a method of preparing an electrical contact comprising, blending together sub-micron size particles of silver with less than two micron size particles of cadmium oxide to form an intimate mixture, heating the mixture to a temperature of about 321° C. to about 550° C. in a reducing atmosphere to reduce the cadmium oxide and form an alloy powder of silver and cadmium, holding said alloy powder at said temperature and oxidizing the alloy powder at said temperature to form a silver-cadmium oxide alloy powder with particles of cadmium oxide finely dispersed within grains of silver. The silver-cadmium oxide alloy powder is then compacted, sintered and formed into an electrical contact.

In an alternative embodiment an alloy powder of cadmium and silver already prepared from sub-micron size particles of silver and less than two micron size particles of cadmium oxide is heated in an inert atmosphere to a temperature of from about 321° C. to about 550° C. The atmosphere is then changed to an oxidizing atmosphere and the cadmium oxidized to cadmium oxide to form a silver-cadmium oxide alloy powder with particles of cadmium oxide dispersed within grains of silver. The silver-cadmium oxide alloy powder is then compacted, sintered and formed into an electrical contact.

DETAILS OF THE PREFERRED EMBODIMENTS

The present invention relates to a method of making an intimate mixture of silver-cadmium oxide powder which provides acceptably highly dense and blister-free contacts having uniformly dispersed particles of cadmium oxide within grains of silver and having high ductility and erosion resistance. The method employs sub-micron size silver powder having a bulk density of from 50 to 10 grams per cubic inch as measured by a Scott volume meter, and less than two micron size cadmium oxide powder, as measured by a scanning election microscope. The method of the present invention also employs a low oxidation temperature and from about 5% to 50% by weight cadmium oxide, balance essentially silver, and preferably about 10% to 20% by weight of cadmium oxide, balance essentially silver, for optimum electrical and erosion resistant properties.

Figure 1:
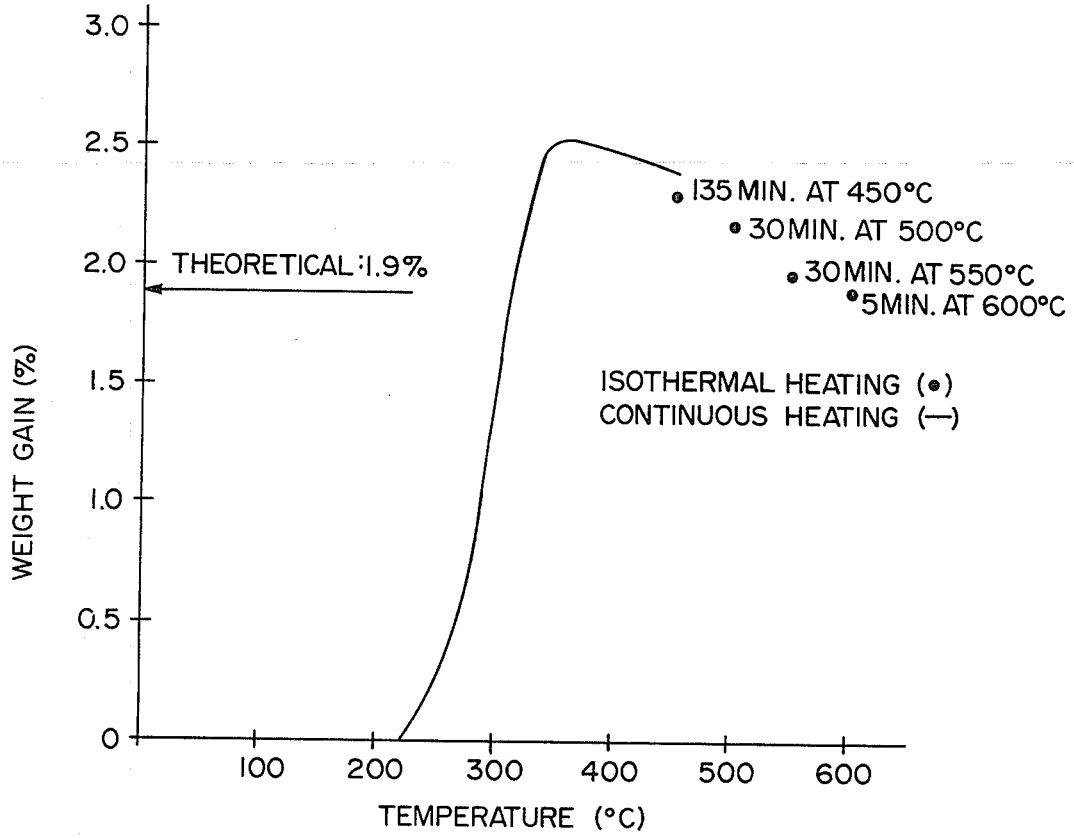
FIG. 1 graphically depicts the thermogravimetric oxidation of a reduced 85% silver and 15% by weight cadmium oxide powder mixture in air; continuous heating to 450° C. at 5° C. per minute, and isothermal step heatings at 450° C., 500° C., 550° C. and 600° C.

When a mixture of sub-micron size silver powder and about one micron size cadmium oxide powder is given a reduction treatment at a temperature between the melting point of cadmium of about 321° C., and 400° C. for about one hour, the powder becomes a single phase alloy of silver with the cadmium, still maintaining individual particle characteristics with some degree of particle interconnection as a result of the formation of necks among neighboring particles. Upon subjecting the reduced powder to four different oxidation temperatures; 400° C., 500° C., 550° C. and 600° C., and evaluating the sinterability of each of the four groups of samples, it was found that the lower the oxidation temperature was, the lower the sinterability. It was also found that the hardness and electrical conductivity of sintered material varied with the oxidation temperature of the powder. It should be noted, however, that the weight loss of the sample after sintering increases with decreasing oxidation temperature. These variations were unexpected since the use of a lower oxidation temperature would be expected to result in lesser particle growth and higher sinterability. The thermogravimetric analysis of the oxidation process of a reduced 15% cadmium oxide mixture by weight, balance essentially silver, ie., silver-cadmium alloy powder, revealed that, instead of the calculated weight gain of 1.9%, the sample gained as much as 2.5% at about 400° C., and that upon further increases in temperature, the total weight gain decreases to the theorectical level of 1.9% at 600° C. as shown in FIG. 1. In an isothermal holding at 450° C. for 135 min., the sample still retained an excess quantity of oxygen of about 0.4%.

It is theorized that the observed phenomenon of an extra oxygen gain associated with the low temperature oxidation of silver-cadmium alloy powder indicates an unknown change at the interface of the silver and cadmium oxide particles. Although applicants do not wish to be bound by theory it is believed that this change is associated with a low temperature stable compound which is completely decomposed later at a high temperature near 600° C. Therefore, a compact pressed from the silver-cadmium oxide alloy powder processed at a 400° C. oxidation temperature should sinter to a lower density level due to the interference effect at the sintering temperature of the gaseous decomposition product with pore closure.

A detailed examination was carried out by the differential thermal analysis technique using a mixture of silver oxide and cadmium oxide powders. It was found that the exothermic reaction starting at about 200° C. is associated with the formation of a compound, believed to be $Ag_2CdO_2$, at the silver oxide and cadmium oxide contact area. An endothermic reaction starting at about 350° C. indicates the beginning of the decomposition process of $Ag_2CdO_2$ to Ag and CdO with the liberation of oxygen atoms. The sharp endotermic reaction starting at about 390° C. indicates the melting of either the remaining undecomposed $Ag_2CdO_2$ or the eutectic of the compound and cadmium oxide. A differential thermal analysis run with a lower heating rate of about 1° C. per minute did not register the melting peak, as a result of complete decomposition of the compound before reaching the melting point.

It is theorized that when a sub-micron size silver plus cadmium alloy powder having a high total surface area is heated gradually from room temperature in an oxidizing atmosphere, the alloy powder surface develops a silver oxide layer until the instability temperature of silver oxide of about 190° C. is reached. The portion of silver oxide beneath the cadmium oxide particles, whose nucleation becomes copious above 200° C. due to a more temperature-sensitive diffusion process, undergoes an interface chemical reaction with the overlaying cadmium oxide to form $Ag_2CdO_2$. The formation of $Ag_2CdO_2$ interface can occur even in the absence of $Ag_2O$, as long as oxygen is supplied by diffusion through CdO from the oxygen-containing atmosphere and the temperature is below the decomposition temperature of the compound. As a result, the retention of extra oxygen atoms up to the higher decomposition or melting temperatures is effected. A prolonged heat-treatment of silver-cadmium oxide powder at 400° C., which is above the decomposition temperature of the compound, does not fully decompose the compound due to the kinetic limitation, which becomes more exaggerated when the powder is in a pressed form such as a pressed compact.

The present invention, based on such experimental evidence, defines a method of processing the silver-cadmium oxide powder retaining a fine particle size for acceptably high as-sintered density compacts by way of a low temperature process while avoiding the formation of the density-lowering, blister-causing compound and attaining the other desired characteristics previously discussed.

Figure 2:
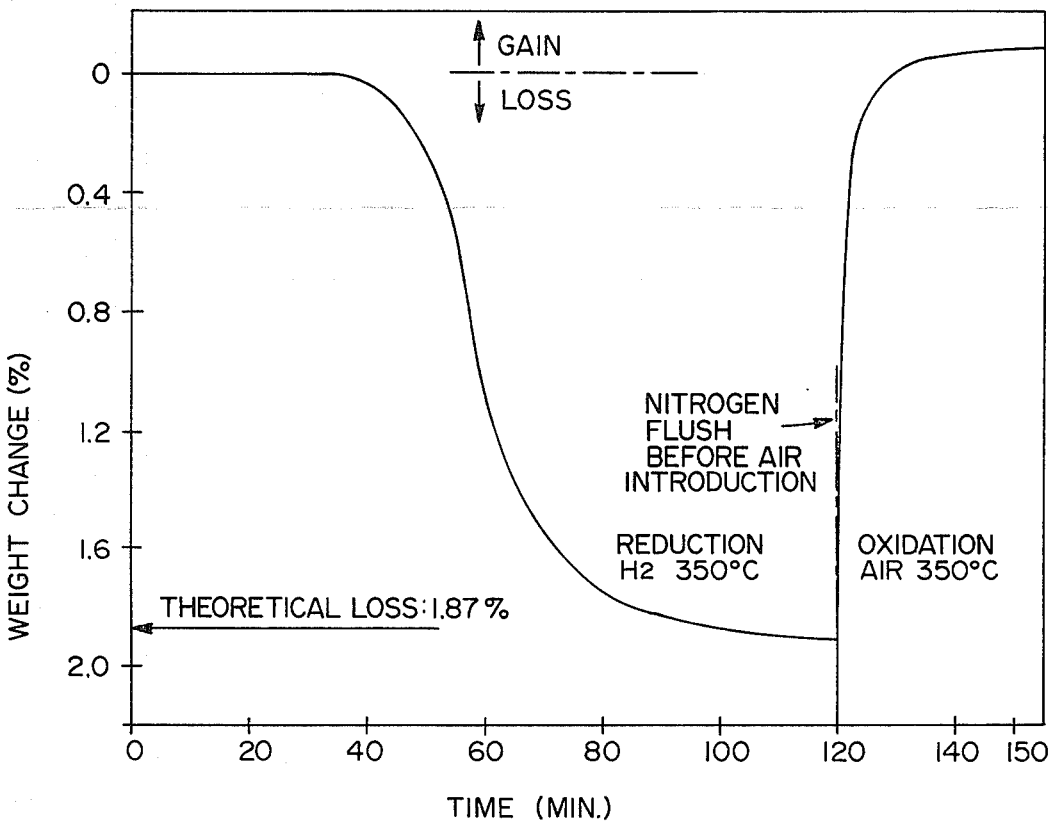
FIG. 2 graphically depicts the thermogravimetric simulation of the in-situ reduction oxidation process of an 85% silver and 15% cadmium oxide by weight mixture.

The avoidance of the compound formation is achieved by exposing the silver-cadmium alloy powder to an oxidizing atmosphere, such as air or oxygen, at the temperature above the thermodynamic stability temperatures of silver oxide and the compound of about 350° C., instead of slow heating from room temperature, thus making it possible to use a lower oxidation temperature then normally possible. In practice, it is more convenient to reduce a silver-cadmium oxide mixture in a reducing atmosphere, such as hydrogen, and change the atmosphere to an oxidizing gas after inert gas flushing while maintaining the same furnace control temperature. The in-situ processing temperature ranges from 321° C. to 550° C., and preferably from about 350° C. to about 425° C., but the schedule of one hour for reduction and one hour for oxidation at 350° C. was found to be most ideal. A thermogravimetric run simulating such proposed in-situ reduction-oxidation method with a 15% cadmium-oxide balance essentially silver material is shown in FIG. 2. It should be noted that no extra oxygen gain is evident during oxidation.

An alternative method is to use a two-step processing procedure where reduction and oxidation are carried out as in the convential method. However, the oxidation step has to be instituted first by heating an already reduced silver-cadmium alloy powder, which was allowed to cool while in the reducing atmosphere, to an oxidizing temperature between about 321° C. and 550° C., and preferably from about 350° C. to about 425° C., in a non-oxidizing atmosphere such as a vacuum, an inert gas or a reducing gas prior to the introduction of an oxidizing gas such as air or oxygen. Following the oxidation step the mixture is compacted, sintered, and formed into an electrical contact. A sieving step may be included following oxidation and prior to sintering, if desired.

The main advantage of this invention lies in that one can use a sub-micron size silver powder in making an intimate mixture of silver-cadmium oxide powder capable of producing acceptably high density as-sintered compacts in combination with the other advantages previously discussed. The retention of highly sinterable fine particle characteristics after the reduction-oxidation process is achieved through the use of the lowest possible processing temperature and avoidance of a blister-causing compound. The conventional processing of a sub-micron size silver plus cadmium oxide mixture, or blend, with the oxidation temperature less than about 550° C., wherein the powder is re-heated to the oxidation temperature following the reduction step, results in a powder contaminated with the compound. A typical density less than 90% theoretical with surface blisters is common, when such powder is compacted and sintered. Using the in-situ method as described, one can obtain a typical density up to 95% theoretical.

In addition to improved sinterability, the use of a lower powder processing temperature results in the refinement of cadmium oxide particle size and improved particle uniformity.

Another advantage of this invention is the simplification of the conventional two discontinuous steps to a single isothermal step in the preferred embodiment. No intermediate sieving and loading operation is necessary.

The as-sintered density and particle morphology also yields in more favorable mechanical properties, facilitating more efficient mechanical working and forming operations with improved electrical properties of the formed electrical contact.

While there has been shown and described what are at present the preferred embodiments of the invention, it will be obvious to those skilled in the art that various changes and modifications may be made therein without departing from the scope of the invention as defined by the appended claims.

What is claimed is:

1. A method of preparing an electrical contact comprising, (a) blending together silver powder having sub-micron size particles with cadmium oxide having particles of less than two micron size to form an intimate mixture thereof, (b) reducing said cadmium oxide at a temperature from about 321° C. to about 550° C. to form an an alloy powder of silver and cadmium, (c) maintaining the temperature of the alloy powder formed in step b at a temperature greater than about 321° C. while changing said reducing atmosphere to an oxidizing atmosphere, (d) oxidizing said alloy powder in an oxidizing atmosphere at a temperature greater than about 321° C. to oxidize said cadmium and precipitate cadmium oxide within grains of silver to form a silver-cadmium oxide alloy powder, (e) compacting, sintering, and forming said silver-cadmium oxide alloy powder into an electrical contact.

2. A method according to claim 1 wherein said temperature is in the range of from about 350° C. to about 425° C.

3. A method according to claim 1 wherein said mixture comprises from about 5% to about 50% cadmium oxide by weight, balance essentially silver.

4. A method according to claim 1 wherein said mixture comprises from about 10% to about 20% cadmium oxide by weight, balance essentially silver.

5. A method according to claim 2 wherein said reducing atmosphere is hydrogen.

6. A method according to claim 5 wherein said oxidizing atmosphere is air.

7. A method according to claim 5 wherein said oxidizing atmosphere is oxygen.

* * * * *